United States Patent [19]

Avaiusini

[11] 4,057,984

[45] Nov. 15, 1977

[54] SKI LOCK DEVICE WITH SINGLE ACTUATING MEANS

[76] Inventor: Mauricio V. Avaiusini, 1038 S. 317th St., Federal Way, Wash. 98003

[21] Appl. No.: 706,888

[22] Filed: July 19, 1976

Related U.S. Application Data

[63] Continuation-in-part of Ser. No. 634,403, Nov. 24, 1975.

[51] Int. Cl.[2] ..... E05B 69/00; E05B 9/08

[52] U.S. Cl. ..... 70/58; 70/370; 292/62

[58] Field of Search ..... 70/57, 58, 59, 61, 62, 70/364 R, 451, 370, 100; 211/4, 7, 60 SK; 280/11.37 A, 11.37 K, 11.37 E; 292/58, 62

[56] References Cited

U.S. PATENT DOCUMENTS

| | | | |
|---|---|---|---|
| 200,319 | 2/1878 | Ludlow | 70/451 |
| 452,776 | 5/1891 | Doty | 292/DIG. 20 |
| 1,529,071 | 3/1925 | Leach | 70/370 |
| 2,956,812 | 10/1960 | Lundquist | 211/60 SK |
| 3,102,411 | 9/1963 | Friedman | 292/62 |
| 3,636,739 | 1/1972 | Smedley | 70/58 |

FOREIGN PATENT DOCUMENTS

| | | | |
|---|---|---|---|
| 1,512,617 | 1/1958 | France | 70/58 |
| 741,678 | 5/1943 | Germany | 70/59 |

*Primary Examiner*—Paul R. Gilliam
*Assistant Examiner*—Kenneth J. Dorner
*Attorney, Agent, or Firm*—Greybeal, Barnard & Uhlir

[57] ABSTRACT

A locking device for a pair of skis is actuable with one hand and includes a first and second attachment mountable on respective skis. A key operated first attachment includes an actuating means having an end which is positionable flush with the underside of its ski in a retracted position and is projectible, as the key is inserted, substantially beyond the underside of its ski in an extended position. The projectible portion includes a head which is part of a lock bolt and it is sized to be received through an orifice on the end of a shank portion of the second attachment. One lock surface is formed on the inward end of the lock bolt head and a second lock surface is provided inward of the orifice on the mounting bolt shank of the second attachment. Rotation of the key causes a mating of the locking surfaces which locks the first and second attachments so that the skis are secured together. Each attachment includes a mounting bolt which is threadably received into an opening formed from the upper to the lower surface of its ski.

7 Claims, 7 Drawing Figures

SKI LOCK DEVICE WITH SINGLE ACTUATING MEANS

CROSS-REFERENCE TO RELATED APPLICATION

This application is a continuation-in-part application of U.S. Ser. No. 634,403 entitled A LOCKING DEVICE FOR SECURING SKIS, filed on Nov. 24, 1975 by the same inventive entity.

BACKGROUND OF THE INVENTION

1. Field of the Invention

This invention relates to a locking device for securing a pair of skis and, more particularly to a pair of locking attachments secured near opposite ends of a pair of skis for preventing theft.

1. Description of the Prior Art

Locking devices for use with a pair of skis are generally known and have been used to secure the skis to each other or to a stationary object. Both U.S. Pat. No. 3,742,740 granted July 3, 1973 and U.S. Pat. No. 3,739,606 granted June 19, 1973, both issuing to Edwald Pyzell, describe the growing problem of the theft of skis at ski resorts and similar places. They describe how the owners of skis frequently leave their skis unattended outside a ski lodge or other similar place for indefinite periods of time. This fact coupled with the increased popularity of skiing resulting in an increased number of skiers utilizing the available facilities has made it much easier for a thief to carry off an unattended pair of skis unnoticed by the true owner. Both of these patents describe an anti-theft device incorporating a U-shaped bolt assembly which is received and locked near the front portion of a pair of skis to secure the skis together.

Other examples of heretofore known devices for securing a pair of skis together are described in U.S. Pat. No. 3,636,739, granted Jan. 25, 1972 to Richard Smedley; German Pat. No. 2,003,966, granted Aug. 19, 1971; Swiss Pat. No. 133,497, granted Aug. 16, 1929 and Norwegian Pat. No. 70,431, granted May 13, 1946. These devices require a detachable portion of the ski lock device to be carried by the skier in order to secure the skis during periods of non-use. These detachable portions are often bulky, hard to actuate, and can involve extensive manipulation of the skis and/or cooperating portions to engage the mating components. Additionally, these prior art devices are difficult for a skier to actuate whose dexterity has been hindered by the lower temperatures often prevailing while skiing.

In addition to the hereabove identified prior art, the parent patent application should be consulted for putting the instant invention into proper perspective. The locking device disclosed in that application includes a similar device for locking a pair of skis to a fixed structure. However, in that embodiment each first attachment includes a lock bolt movable between a retracted position and a projecting extended position. Each second attachment includes a tumbler member for operating the locking device between a locked position and an unlocked position. In using this locking device, the skier had to hold the skis together with one hand and, at the same time, he had to press the locking bolt with that same hand while using his other hand to operate the key in order to actuate the locking mechanism.

Although many do not include a tumbler actuated means, other devices are known for securing a pair of skis together primarily for transporting the skis from one location to another. As is well known to most skiers, it is highly desirable to bind a pair of skis together when moving the skis from one place to another. Many devices which can perform this function are known, one of the more simple being a stretchable strap with hooks at each end. These and other similar binding devices require a skier to carry an additional item to hold the skis together during transportation in addition to a locking device which is adapted to be used as an anti-theft device. Accordingly, the owner of a pair of skis is put to the additional expense and inconvenience of obtaining and using an extra device solely for holding the skis together when moving them from place to place.

SUMMARY OF THE INVENTION

The present invention relates to a locking pair of first and second attachments actuated by a tumbler means and fixedly positioned near opposite ends of a pair of skis for securing the skis against theft. According to an aspect of the invention, an anti-theft device is provided which secures a pair of skis to a fixed structure. The device includes a pair of first and second attachments fixedly mounted on a pair of skis near opposite ends. Each first attachment includes a lock bolt movable between a retracted position in which it is flush with the underside of its ski and an extended position in which it projects substantially beyond the underside of its ski. An actuating means includes a tumbler member to operate the locking device between a locked and unlocked position. Each second attachment includes a locking device for receiving the lock bolt in its extended position. According to another aspect of the invention, a first attachment is mountable on a ski and cooperates with a second attachment on the other ski to secure the skis together. The first attachment includes a tumbler actuated lock bolt which is movable axially between a retracted position in which the lock bolt is flush with the underside of its ski and an extended position in which the lock bolt projects substantially beyond the underside of the ski. The lock bolt is engaged by the second attachment on the other ski thus securing the skis together.

According to another aspect of the invention, a second attachment is mountable on a ski and cooperates with a first attachment to secure the skis together. The second attachment includes an orifice which is disposed near the bottom end of a threaded shank for receiving an extended portion of the first attachment mounted on the other ski. The orifice is sized to receive the projecting portion of the first attachment therein and further includes a locking surface to engage a portion of the lock bolt extending from the first attachment.

According to yet another aspect of the invention, an actuating means on a first attachment is depressed to extend a lock bolt from the lower surface of the ski which can be locked into the second attachment on the opposite ski for securing the skis together.

According to still another aspect of the invention, a first and second attachment for locking a pair of skis together each includes a mounting bolt which is initially threaded into an opening from the upper to the lower surface of each ski. The remaining portions of each attachment can then be fixedly secured to the mounting bolt atop the upper surface of the respective skis.

According to another aspect of the invention, a first and second attachment for locking a pair of skis together are mountable at any point along the longitudinal axis of a pair of skis. Each attachment includes a shank which is positionable flush with the underside of its ski by means of a washer disposed between the upper surface of its ski and the mounting bolt head.

In view of the foregoing, it is an object of this invention to provide a locking device for a pair of skis in which a single actuable member both locks and unlocks the device.

It is another object of the invention to provide a locking device with a single actuable member operable with one hand for locking and unlocking the device so that the skier can hold the skis with one hand and use his other hand to actuate the locking assembly.

It is yet another object of the invention to provide a locking device for a pair of skis which is extremely simple to actuate but yet is very strong and durable in construction.

It is still another object of the invention to provide a locking device which can be used to secure numerous different types of skis such as those used in snowskiing or waterskiing.

It is yet another object of the invention to provide a ski lock attachment which is engageable with each ski without exposed pins, screws or the like.

It is another object of the invention to provide a ski lock device which can be mounted at any desired point along the longitudinal axis of the ski.

It is still another object of the invention to provide a ski lock attachment for a pair of skis in which the lower portion thereof are substantially flush with the underside of respective skis.

It is yet another object of the invention to provide an anti-theft device for a pair of skis which also holds the skis with their lower surfaces juxtapositioned for convenient transportation thereof.

It is yet another object of this invention to provide a locking device for securing a pair of skis which is adaptable to fit a number of different types and sizes of skis by merely changing the thickness of a washer.

It is another object of the present invention to provide a locking device having a tumbler actuated means which can be operated in a few seconds time.

It is yet another object of this invention to provide a locking device for a pair of skis which remains fixedly attached atop the upper surface of each ski so that no detachable components, other than a key, must be carried by a skier.

Other and additional advantages will become apparent from the following description taken in conjunction with the accompanying drawings.

DESCRIPTION OF THE PREFERRED EMBODIMENT

Figure 2:
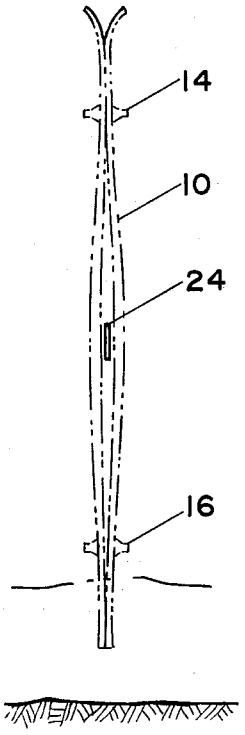
FIG. 2 is an end view taken along lines 2—2 of FIG. 1, showing a pair of skis locked together within an elongated rail extending horizontally between the arcuate portion of the skis.
Figure 1:
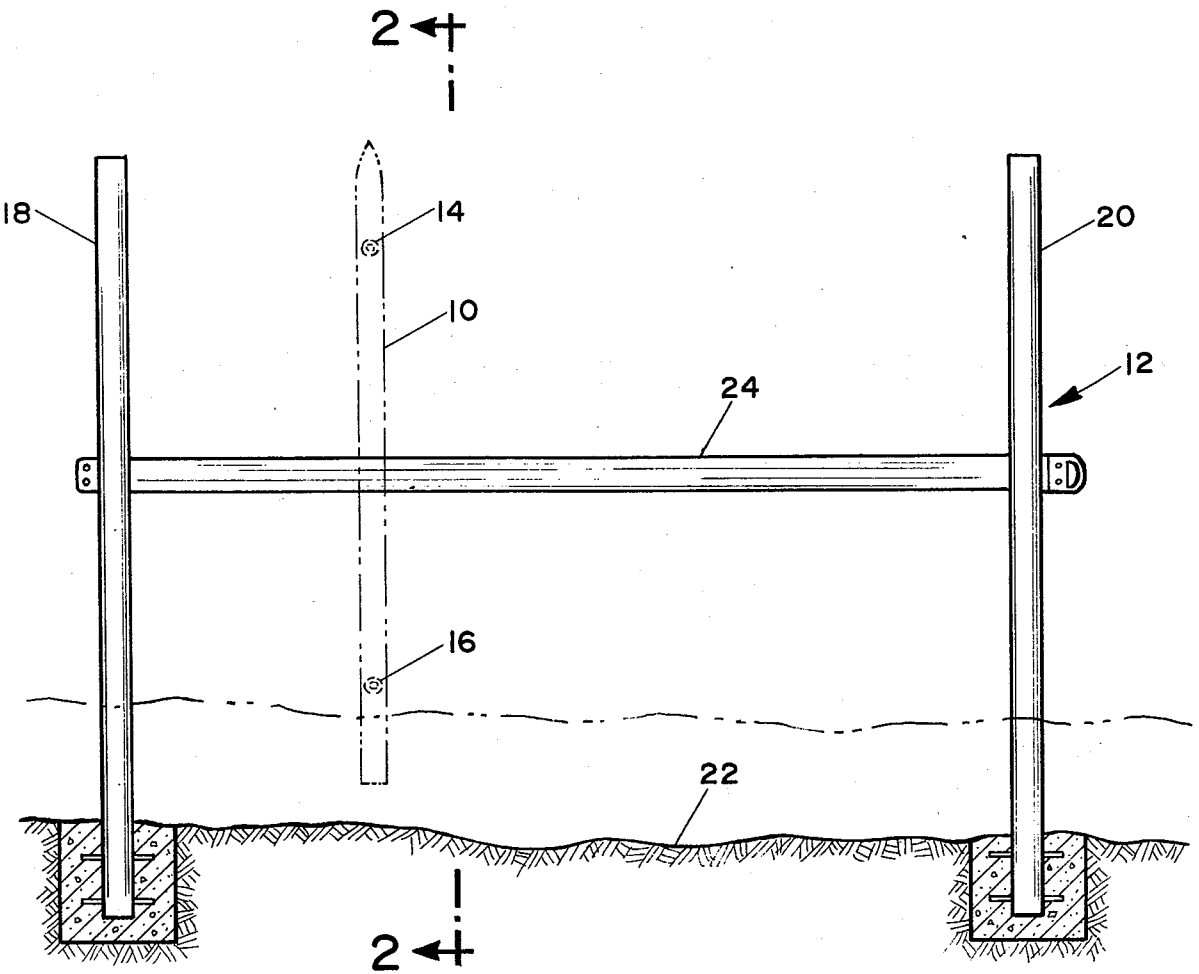
FIG. 1 is an elevational view showing a typical pair of skis secured to a ski rack by the ski lock device according to the instant invention.

Referring initially to FIGS. 1 and 2, a typical pair of skis 10 is shown, in broken line, secured to a ski rack by a pair of locking devices fixedly mounted to the skis near opposite ends. It is well-known that skis are not merely flat with elongated planar surfaces; but rather, they are thicker in cross section near the mid-point where a binding (not shown) is normally attached and are thinner near each end of the ski. Additionally, as can be best seen in FIG. 2, the skis, when viewed from a side, are slightly bowed or arcuate such that when a ski is placed against a planar surface the mid-point of the ski is slightly elevated. Thus, the novel locking device of this invention utilizes these variations in thickness and shape, in conjunction with a stationary structure, to secure the skis against theft.

One embodiment of a typical ski rack which could be used in conjunction with the locking devices according to the instant invention is illustrated in FIG. 1. In preferred form, ski rack 12 comprises a pair of upright poles 18 and 20 held firmly in a vertical position in ground 22. A horizontal rail 24 is slidably attached to poles 18 and 20 and is adapted to be moved vertically with respect to the ground thereby compensating for varying snow depths. It is reasonable to expect that due to the simple construction and low cost, ski rack 12 could be provided in many locations around a ski lodge for the convenience of skiers.

Locking devices 14 and 16, situated near opposite ends of a pair of skis, are identical and will now be described in conjunction with FIGS. 3 and 4. In preferred form, each device comprises a first attachment 26 and a second attachment 28 which are fixedly mounted on respective skis. To secure skis 10 together, either for transporting from place to place or for locking over the rail of a ski rack as previously described, the lower surfaces are initially juxtapositioned such that first attachment 26, mounted on one ski, and second attachment 28, mounted on the other ski, are coaxially aligned. A key 30 is then inserted in an opening atop first attachment 26 and is then depressed extending a portion of a lock bolt, described in greater detail hereafter, from the underside of its ski. In this extended position, the projecting portion of first attachment 26 is received in second attachment 28 mounted on the opposite ski. Key 30 is then rotated 90° wherein the projecting portion of first attachment 26 is moved to a position of interference in second attachment 28 and the key is then withdrawn. The other locking device is positioned near opposite ends of the skis can then be locked in the identical fashion as hereabove described. Preferably, a common key operates both locking devices 14 and 16 so that a skier need only carry one key in order to secure the skis.

Still referring to FIGS. 3 and 4, the component parts of each first attachment 26 of identical locking devices 14 and 16 will now be described. In preferred form, first attachment 26 comprises a housing 32 having an enlarged outwardly opening cup-like portion 34 at one end and a lesser diameter cap portion 36 at its opposite end. A cylindrical side wall 38 is formed within cup-like portion 34 and it extends inwardly to annular shoulder 40. An annular channel 42 is formed on cylindrical side wall 38 extending along the entire circumference thereof. Within the interior of housing 32, a cylindrical cavity 44 is formed extending axially along the center line of the housing. It is sized to receive a spring which will be described later. An opening 46 is formed in the outward end of cap 36 through which a portion of the actuating means, also described in greater detail hereafter, projects to receive key 30.

As indicated herebefore, each of the identical locking devices 14 and 16 has a projectible portion which is a part of an actuating means and can be extended from one attachment to the other for locking the skis together. In preferred form, the actuating means comprises an axially extending lock bolt 50 having a head 52 at a projectible end thereof. A locking surface 54, adapted to engage a portion of second attachment 28, is provided on the inward face of head 52. Head 52 is preferably rectangularly shaped and is sized to be slightly smaller than a receiving opening formed in the end of second attachment 28. However, it should be understood that head 52 could have any non-circular cross-sectional configuration so long as it could be moved into a point of interference in second attachment 28 so that it could not be withdrawn.

A tumbler means, adapted to be operated by key 30, is formed as an integral portion of lock bolt 50 and includes a tumbler body 56 which is cylindrical and is coaxially attached thereto. A plurality of wafers 58 are provided in tumbler body 56 disposed for radial movement under the influence of the teeth of key 30. As is well-known in the lock art, wafers 58 protrude from the cylindrical side wall of body 56 with key 30 withdrawn. As key 30 is inserted through an opening (not shown) in wafers 58 they move radially until, with key 30 at its inward end position, wafers 58 are sufficiently retracted into body 56 so that their projecting end portions are substantially flush with the cylindrical side wall of body 56. A pin stop 60 is provided on body 56 and projects radially therefrom to engage a stationary portion of the mounting bolt, hereinafter described, to limit the rotation of the actuating means.

A button 62 is provided at the end of tumbler body 56 and projects outwardly through opening 46 in housing 32. A keyway 64 is provided in the end of button 62 and is sized to receive key 30 therein.

In preferred form, a spring 66 is provided for biasing the actuating means so that bolt head 52 is normally urged toward its withdrawn position. One end of spring 66 abuts end wall 68 of tumbler body 56 and the other end contacts an end portion mounting bolt for first attachment 26, described in greater detail hereafter.

Figure 3:
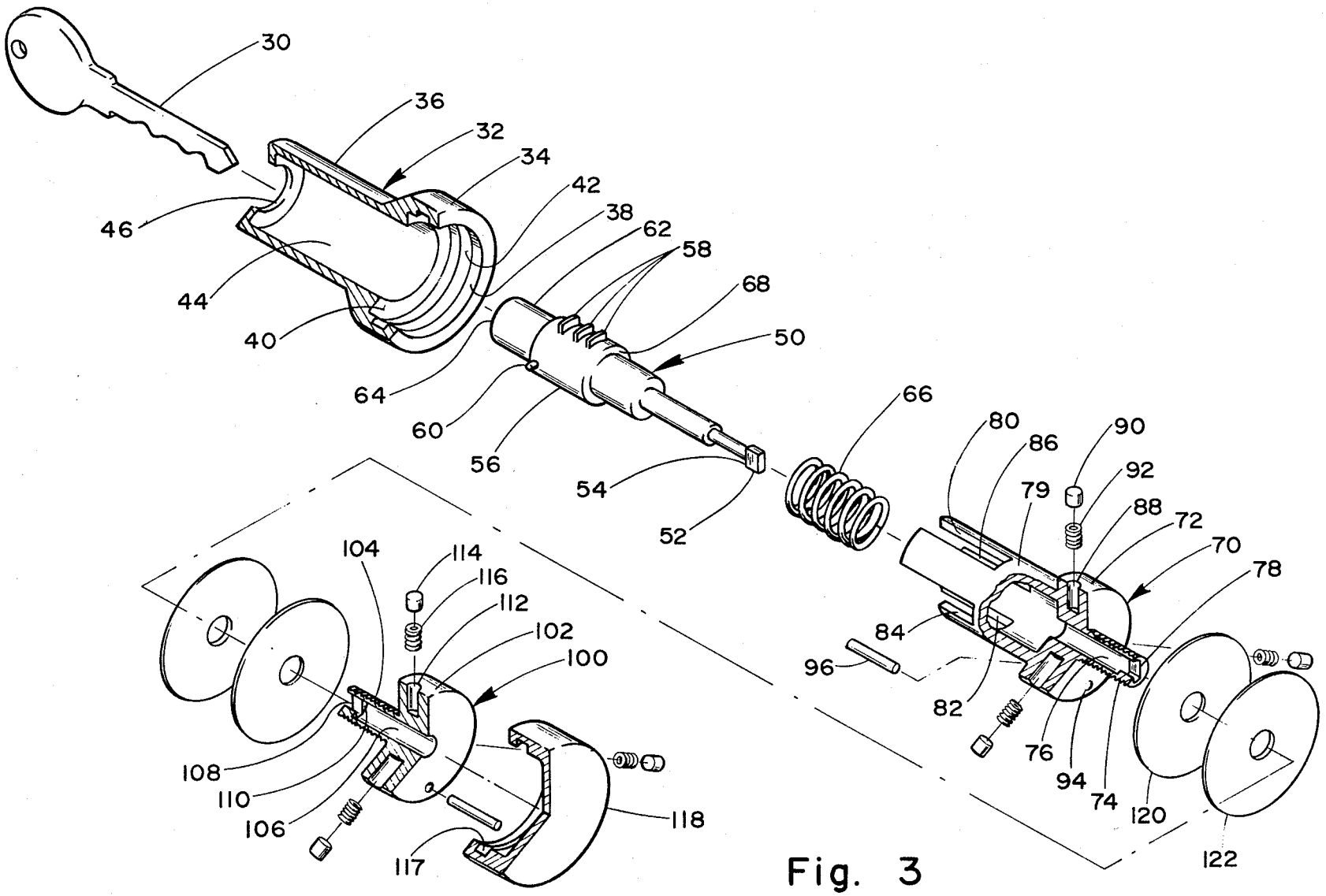
FIG. 3 is an exploded pictorial view of a single locking device according to the instant invention.
Figures 4, 5, 6, 7:
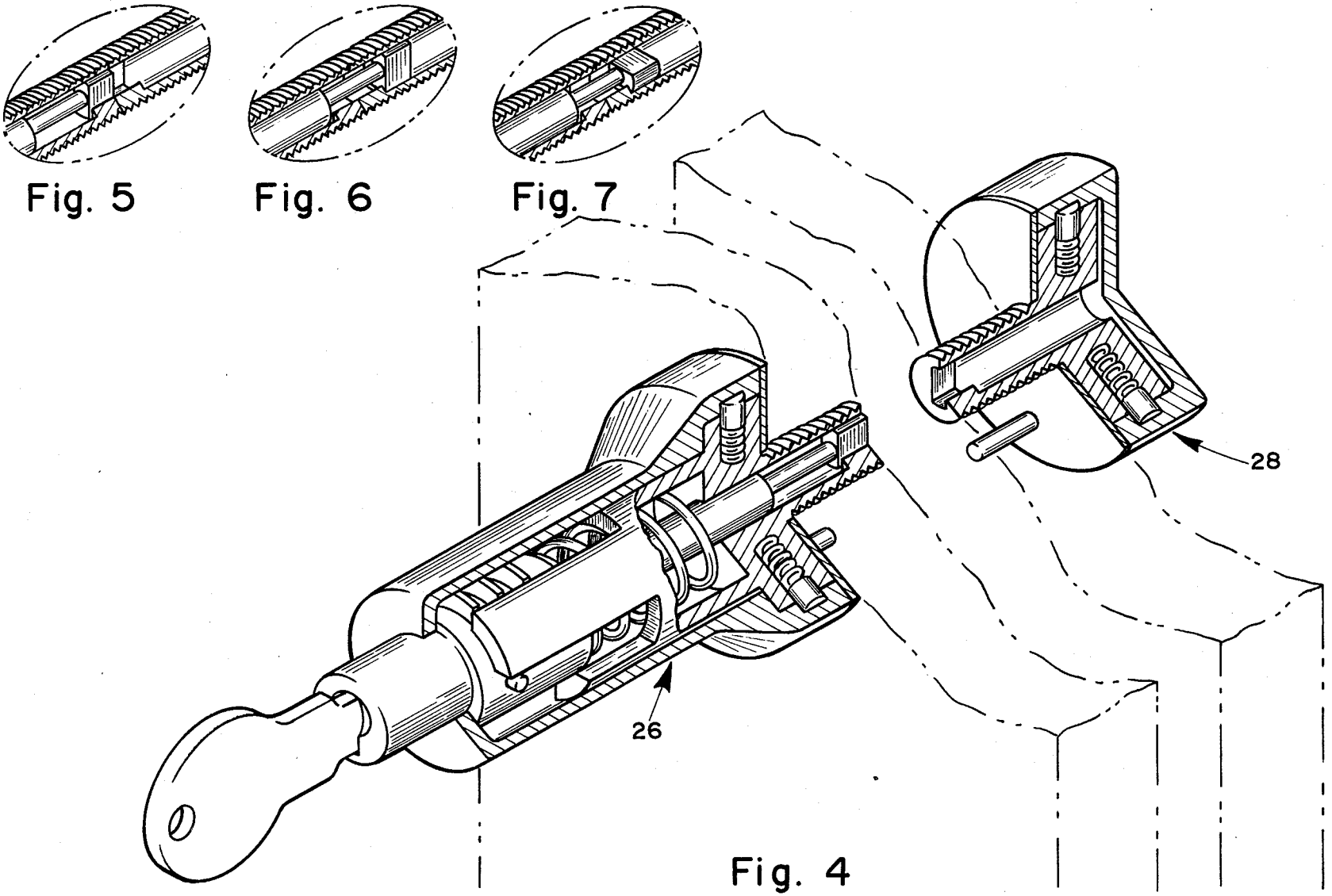
FIG. 4 is a pictorial view of a ski lock device according to the instant invention depicted as coaxially mounted on a pair of skis and having cut away portions to show the internal components.
FIGS. 5, 6 and 7 are fragmented views of the facing shank end portion of each locking device illustrating the locking sequence.

Still referring to FIGS. 3 and 4, a mounting bolt 70 is provided to secure first attachment 26 to its ski. In preferred form, mounting bolt 70 comprises a cylindrical head portion 72 with a shank 74 extending axially from one end face. A passageway 76 is formed within shank 74 and is sized to rotatably receive a portion of lock bolt 50 therein. An opening 78 is formed in the closed end wall of shank 74 and has a non-circular cross-section which substantially matches head 52 of lock bolt 50 in both size and cross-sectional configuration. Opening 78 forms a guide for lock bolt 50 so that head 52 is aligned with a receiving portion of second attachment 28 on the opposite ski.

At the opposite end of mounting bolt 70, cylindrical wall 79 is provided and it extends axially from the end face of head 72 so that it surrounds the front portion of lock bolt 50. Four rectangular slots 80, 82, 84, 86 are formed in wall 79 and are particularly adapted to cooperate with wafers 58 protruding from tumbler body 56. Rectangular slots 80 and 82 are formed on diametrically opposite sides of cylindrical wall 79 so that both slots are aligned with guide openings 78 at the end of shank 74. Rectangular slots 84 and 86 are also formed diametrically opposite in wall 79 but are displaced 90° from rectangular slots 80 and 82. The outward end portion of side wall 79 formed between rectangular slots 82 and 84 is cut away to provide room for rotational movement of pin stop 60 projecting radially from the side wall of tumbler body 56.

Three radially extending sockets 88 are formed in the side wall of mounting bolt head 72 along a radial plane, preferably equally displaced about a central axis. A detent member 90 is positioned within each socket 88 and is urged radially by a spring 92. Each detent member 90 is sized to be received into annular channel 42 formed on interior side wall 38 of housing 32. A cup 34 of housing 32 is positioned over mounting bolt head 72 so that each detent member 90 can be urged into annular channel 42. Each detent member 90 is sufficiently long so that its side wall engages both annular channel 42 and opening 88 in the side wall of mounting bolt head 72 thereby preventing axial movement of housing 32 with respect to the mounting bolt 70. Although in preferred form three detent members 90 are employed to lock housing 32 to mounting bolt 70, it should be understood that any number of detent members could be used.

An opening 94 is provided through mounting bolt head 72 along an axis parallel with the axis of mounting bolt 70 and is sized to receive mounting pin 96 therein. The positioning of mounting bolt 70 on its ski will be described in greater detail hereafter.

As indicated herebefore, second attachment 28 receives the projecting portion of the locking device from first attachment 26 to secure the skis together. Still referring primarily to FIG. 3, in preferred form second attachment 28 comprises a mounting bolt 100 having a cylindrical head 102 and a shank 104 extending axially from one face thereof. A passageway 106 is formed within mounting bolt 100 and extends axially in both shank 104 and mounting bolt head 102. An orifice 108 is formed in the closed end of shank 104 and has a size and cross-section configuration which is at least slightly larger than lock bolt head 52, at the end of the projectible part of the actuating means. A locking surface 110 is provided on the inward end wall of shank 104 adjacent the inward opening of orifice 108.

In the same manner as heretofore described in conjunction with first attachment 26, mounting bolt 100 is provided with three radially extending sockets formed in the side wall of mounting bolt head 102 along a radial plane, also preferably equally displaced about the central axis. A detent member 114 is disposed within each socket 112 and is urged radially by spring 116. A cup-shaped end cap 118 is provided with an annular channel 117 extending circumferentially along the interior side wall thereof. The cavity within end cap 118 is sized to receive mounting bolt head 102 therein so that annular channel 117 can be aligned with sockets 112. As heretofore described, the engagement of each detent member 114 with annular channel 117 then prevents axial movement of cap 118.

As previously mentioned, each first attachment 26 and each second attachment 28 of identical locking device 14 and 16 are firmly held adjacent the upper surface of its respective ski by a mounting bolt. Accordingly, the positioning of first attachment 26 on a ski will now be described; however, it should be understood that the indentical procedure will be followed to mount second attachment 28 on its ski. Referring now to FIG. 4 in conjunction with FIG. 3, mounting bolt 70 of first attachment 26 includes mounting bolt head 72 and a shank 74 extending axially from the end face of the bolt head. In preferred form, shank 74 is threaded with a conventional type thread which is known per se. The component parts of each first and second attachment 26 and 28 would be provided disassembled in a kit form which might include a locating guide. The guide assists in determining the exact mounting point along the longitudinal axis of skis 10 for mounting locking devices 14 and 16. After the lengthwise location of the mounting bolt is ascertained, an opening can then be formed from the upper to the lower surface of each ski by a conventional drill or other well-known device. The opening is preferably positioned midway between either side edge of the ski. As previously mentioned, the thickness of the ski along the longitudinal axis normally varies with the thinner portions being at either end. In addition, since a longitudinally extending groove is often provided in the lower surface of each ski, the mounting opening may be situated in that groove. The guide can be moved lengthwise along each side of the ski until the point along the longitudinal axis of the ski is located where the thickness of the ski approximately corresponds to the length of shank 74. After the opening is formed, a conventional tap is used to provide mating threads on the internal wall of the opening. Shank 74 is then threaded therein until head 72 is seated adjacent the upper surface of the ski. Thereafter, a blind opening, also fashioned by means of a drill or the like, is created in the upper surface of ski 10 using opening 94 in mounting bolt head as a guide. Mounting pin 96 is then inserted through opening 94 so that its outward end extends into the blind opening formed in the upper surface of the ski and thus preventing the mounting bolt from being unscrewed.

While it should be understood that mounting bolt 70 can be disposed on the upper surface of its ski without the need of spacers, a spacer may be used to allow increased flexability in the selection of a point along the longitudinal axis at which to form the mounting opening. For example, still referring to FIGS. 3 and 4, a pair of washers 120 and 122 may be provided having an opening therein sized to receive shank 74 therethrough. Washer 120 has a different thickness than washer 122 so that a number different spacing thickness is available and only involves the selection of various combinations of either none, one or two washers. This would allow mounting bolt head 72 to be seated atop the upper surface of its ski at a number of different mounting points while still positioning the end of shank 74 flush with the underside of its ski.

Next, lock bolt 50 and spring 66 are inserted in the opening at the end of mounting bolt 70. Wafers 58 protruding from the cylindrical side wall of tumbler body 56 are received in rectangular slot 80 which in turn aligns mounting bolt head 52 with guide 78 at the lower end of shank 74. Housing 32 is then inserted down over mounting bolt 70 until annular channel 42 is aligned with the plane of detent members 90. Under the influence of spring 92, each detent member is then forced into annular channel 42 locking housing 32 on mounting bolt 70.

As previously indicated, each locking device 14 and 16 is identical each to the other, and the locking sequence will now be described in conjunction with FIGS. 3 through 7. First, to secure skis 10 together, either for transporting or over the rail of a ski rack, the lower surfaces are juxtapositioned such that each first attachment 26 mounted on one ski and each second attachment 28 mounted on the other ski are coaxially aligned. While holding the skis in this position with one hand, the skier then inserts key 30 in keyway 64 which is formed in button 62 protruding from the top of housing 32. The insertion of key 30 to its end position in keyway 64 causes wafers 68 of the tumbler means to be radially withdrawn so that they are clear of slot 80 in cylindrical wall 79. At this time head 52 of the actuating means is still flush with the outward end of shank 74 (FIG. 5). Key 30 and button 62 are then depressed extending lock bolt head 52 into orifice 108 formed in the end of shank 104 of second attachment 28 (FIG. 6). Key 30 is then rotated 90° to the locked position causing lock surface 54 on the inward end of anchor bolt head 52 to engage locking surface 110 formed at the end of shaft 104 (FIG. 7).

In this position and as best seen in FIGS. 3 and 4, pin stop 60 would then be rotated against the side wall of slot 82 aligning wafers 58 with radial slot 84. Key 30 is then withdrawn allowing wafers 58 to move radially into slot 84 thereby locking bolt 50. As will be apparent, in unlocking each locking device 14 and 16 the reverse procedure as hereabove described is followed.

As has been herebefore described, each locking attachment 14 and 16 includes first and second attachments which are threadably received into an opening formed from the upper to the lower surface of each ski. It should be understood, however, that the mounting bolts could be affixed to each ski by means other than threads including such a well-known method as gluing or the like. However, since the locking device of the instant invention would likely be sold in kit form, the locking device could be considered an accessory for skis and may well be installed by either the ski shop at the same time the bindings are attached to the skis or by the purchaser of the skis. In addition, it should further be understood that the mounting bolts could be integrally formed during the manufacture of the ski. Final assembly of each locking device would then only require the positioning of the actuating means on the pre-formed bolt head and inserting the outer housing thereover.

While the locking devices of the present invention utilize an actuating means which is disposed entirely in one attachment, it should be understood that various alternative embodiments could also be employed. For example, the operative parts of the actuating means could be divided so that they could be situated in either the first or the second attachment or any combination thereof. In more fully appreciating the various embodiments of the present invention, my prior patent application, hereinbefore fully identified, should be consulted.

The invention may be embodied in other specific forms without departing from the spirit or central characteristics thereof. The present embodiment is therefore to be considered in all respects as illustrative and not restrictive, the scope of the invention being indicated by the appended claims rather than by the foregoing description, and all changes which come within the meaning and range of equivalency of the claims are to be embraced therein.

What is claimed is:

1. Apparatus for locking a pair of skis together with their lower surfaces in juxtaposition, comprising:

a first attachment mountable onto an upper surface portion of a first ski, comprising a mounting bolt having a tubular shank part adapted to snugly fit into an opening therefor formed through the first ski, between the upper and lower surfaces of such ski, an enlarged head part connected to said shank part and adapted to project upwardly from the upper surface of such ski, and an end surface on said shank part opposite the head part which is at least substantially flush with the underside of the first ski;

a second attachment mountable onto a corresponding upper surface portion of a second ski, comprising a mounting bolt having a tubular shank part adapted to snugly fit into an opening therefore formed through the second ski, between the upper and lower surfaces of such ski, an enlarged head part connected to said shank part and adapted to project upwardly from the upper surface of such ski, and an end surface on said shank part opposite the head part which is at least substantially flush with the underside of the second ski, said end surface including a non-circular end opening bordered internally of said shank part by lock surface means;

lock bolt means including a lock bolt having an end portion which in cross-sectional shape matches the non-circular end opening and a lock surface on the inner side of said end portion, said lock bolt being normally retracted into the tubular shank part of the first attachment but being extendible out from such tubular shank part into the opening in the end of the tubular shank part of the second attachment; and key operated lock means for rotating the extended lock bolt into a position in which its lock surface is engageable with the lock surface means on the second attachment to prevent the two attachments, and hence the two skis to which they are attached, from being separated.

2. Apparatus according to claim 1, wherein each attachment further includes a housing member which is attached to the head part of the attachment, and wherein one of said housing members houses the key operated lock means.

3. Apparatus according to claim 2, wherein the head part of each mounting bolt includes at least one radially extending socket, wherein a spring is disposed within said socket and a detent member is disposed within said socket radially outwardly of said spring, said spring serving to normally bias said detent member into a position wherein a portion of it projects radially outwardly from the socket, with said socket being deep enough so that the detent means can be pushed down into the socket by applying a force on it in opposition to the spring, and wherein each housing member includes a base portion which surrounds its head part and which includes a radial recess positioned to receive the detent member when the housing is on chamber head part, so that the detent member can enter the recess and thereby prevent removal of the housing from such head part.

4. Apparatus according to claim 2, wherein said key operated lock means and the lock bolt means are both parts of the first attachment, wherein the mounting bolt for such attachment includes an axial guide passageway through which the lock bolt moves, wherein the housing means for such attachment includes a base portion which surrounds the head part of the mounting bolt portion of such attachment and an upper part defining a chamber and including an end wall having an end opening, said key operated lock means including a tumbler housing located within said chamber and including an upper end portion in registry with the end opening in said end wall, said upper end portion including a key receiving opening, and spring means located within said chamer between the head part of the mounting bolt and the tumbler housing of the key operated lock means, with said lock bolt being connected to said tumbler housing, with said spring means normally biasing the lock bolt into a retracted position, and with an endwise inward force on the upper end portion of the tumbler housing serving to press the spring means and move the lock bolt from the retracted position into its extended position.

5. Apparatus according to claim 4, wherein the head part of the mounting bolt of the first attachment includes an axial extension which defines a pair of angularly spaced apart axial slots, and wherein said key operated lock means includes a plurality of tumbler elements which are axially aligned within said chamber and are radially extendible out from and retractable into the tumbler housing by rotation of a key which has been inserted into the key opening, said tumbler elements when extended being located in one of said slots, so that said lock bolt cannot be rotated until the tumbler elements have been retracted from such slot, with one of said slots being positioned such that when the tumbler elements are located in it the end portion of the lock bolt is positioned to align with the orifice of the second attachment, so that said lock bolt can be extended into or retracted out from the second attachment via said orifice, and wherein the second slot is oriented such that when the tumbler elements are in it the lock surface on the end portion of the lock bolt is engageable with the lock surface means on the second attachment.

6. A locking component containing attachment for a ski, comprising:

a mounting bolt having a head part and an axially extending threaded shank adapted to be disposed in an opening formed between the upper and lower surface of a ski, said mounting bolt further including an axially extending passageway therein;

a spacer means locatable between said mounting bolt head part and the upper surface of said ski, and adapted to position said shank with its outward end substantially flush with the lower surface of said ski;

a housing mountable on the head part of said mounting bolt to stand upwardly from the upper surface of said ski, said housing including a portion snugly fittable over the head part of said mounting bolt;

means for securing said housing to the head part of said mounting bolt;

a lock component within said attachment, with at least a portion of said locking component disposed within said passageway;

wherein the head part of said mounting bolt includes at least one radially extending socket, a spring is disposed within said socket, and a detent member is disposed within said socket radially outward of said spring, said spring serving to normally bias said detent member into a position wherein a portion of it projects radially outward from the socket, with said socket being deep enough so that the detent means can be pushed down into the socket by applying a force on it in opposition to the spring; and wherein the housing further includes a means forming a radial recess positioned to receive the detent member when the housing is on the head part of said mounting bolt, so that the detent member can enter the recess and thereby prevent removal of the housing from the head part of the mounting bolt.

7. In combination, an anchorage member; a first ski located on one side of said member, a second ski located on the other side of said member, said skis being positioned with their lower surfaces facing together with upper and lower portions of said facing surfaces being mutually contiguous, and with said anchorage member being located between said upper and lower contiguous portions, a first locking device locking the upper portions of the two skis together, and a second locking device locking the lower portions of the two skis together, so that the two skis cannot be separated from said anchorage member when the mechanisms are locked, and each locking device comprising:

a first attachment mounted onto an upper surface portion of the first ski, comprising a mounting bolt having a tubular shank part snugly fit into an opening therefor formed through the first ski, between the upper and lower surfaces of such ski, an enlarged head part connected to said shank part and projecting upwardly from the upper surface of such ski, and an end surface on said shank part opposite the head part which is at least substantially flush with the underside of the first ski;

a second attachment mounted onto a corresponding upper surface portion of the second ski, comprising a mounting bolt having a tubular shank part snugly fit into an opening therefore formed through the second ski, between the upper and lower surfaces of such ski, an enlarged head part connected to said shank part and projecting upwardly from the upper surface of such ski, and an end surface on said shank part opposite the head part which is at least substantially flush with the underside of the second ski, said end surface including a non-circular end opening bordered internally of said shank part by lock surface means; and lock bolt means including a lock bolt having an end portion which in cross sectional shape matches the non-circular end opening and a lock surface on the inner side of said end portion, said lock bolt being normally retracted into the tubular shank part of the first attachment but being extendible out from such tubular shank part into the opening in the end of the tubular shank part of the second attachment; and key operated lock means for rotating the extended lock bolt into a position in which its lock surface is engageable with the lock surface means on the second attachment to prevent the two attachments, and hence the two skis to which they are attached, from being separated.

* * * * *